US007428793B2

(12) United States Patent
Dwyer

(10) Patent No.: US 7,428,793 B2
(45) Date of Patent: Sep. 30, 2008

(54) PERSONALIZED WOODEN ITEMS AND METHODS FOR FABRICATING SAME

(76) Inventor: Michael H. Dwyer, 672 Gallup Hill, Nixa, MO (US) 65714

( * ) Notice: Subject to any disclaimer, the term of this patent is extended or adjusted under 35 U.S.C. 154(b) by 433 days.

(21) Appl. No.: 11/207,423

(22) Filed: Aug. 19, 2005

(65) Prior Publication Data

US 2007/0042151 A1 Feb. 22, 2007

(51) Int. Cl.
*G09F 7/00* (2006.01)

(52) U.S. Cl. ..... 40/596; 40/618; 428/67

(58) Field of Classification Search ..... 40/596, 40/618, 585, 576; 63/1.13; 428/67
See application file for complete search history.

(56) References Cited

U.S. PATENT DOCUMENTS 2,039,248 A 4/1936 Huppert
2,274,192 A 2/1942 Deaton
2,447,011 A 8/1948 Hayes
2,995,849 A 8/1961 Donnellan
3,590,507 A 7/1971 Wren
4,521,923 A 6/1985 Mackey
4,619,125 A 10/1986 Choi
4,691,460 A 9/1987 Kohl
5,223,316 A 6/1993 Nemzin et al.
5,331,753 A 7/1994 Rodibaugh

*Primary Examiner*—Gary C Hoge
(74) *Attorney, Agent, or Firm*—Armstrong Teasdale LLP

(57) ABSTRACT

A personalized item comprising a frame member, character engagement areas, character blocks and inserts is described. The frame member has a substantially rectangular area therethrough or a rectangular recessed area formed therein. The character engagement areas each include a first character placement template formed therein and each character engagement area is adjacent an elongated side of the rectangular area. Each character block has a first template engaging member, a second template engaging member, and a character retained therebetween. The first template engaging member is configured to engage the first character placement template, and the second template engaging member is configured to engage the second character placement template. The plurality of inserts are configured for insertion into the frame member to substantially cover the character engagement areas and the template engaging members.

16 Claims, 7 Drawing Sheets

PERSONALIZED WOODEN ITEMS AND METHODS FOR FABRICATING SAME

BACKGROUND OF THE INVENTION

This invention relates generally to personalized wooden items, and more specifically to methods for fabricating personalized items, for example, wooden personalized items, such that the items appear to have been carved from a single piece of material.

Personalized items and personalized wooden items are known. However, such items are either carved out of a single piece of material at the time of manufacture of the item using large and costly machinery that cannot be provided efficiently at most points of sale or are typically fabricated in such a way that it is readily apparent that the personalization has been added after fabrication of the item. Further problems associated with most of the methods of personalization after the time of initial fabrication include that the personalization characters cannot readily be centered, spaced or retained in position. All of these problems are seen when some items are configured for personalization, for example, with a person's name, by inserting the letters of the name laterally into a channel and sealing one end of the channel to retain the letters. This solution also requires cutting a channel of some kind of shape that can retain the letters that reaches to the edge of the item, which is costly, and with some items and materials, impractical.

Another solution for personalizing items after the original manufacturing process involves snapping flexible characters, or characters with flexible lugs or hinges, into an opening. However, wooden characters are not flexible. Other non-flexible materials that might be used for personalization also cannot be snapped into place.

Another type of solution involves using rectangular holders that have extensions on the top and bottom. Various personalization characters are press fitted into the rectangular holders, which are in turn press fitted into an opening in the item to be personalized, for example a child's foam puzzle. The edges of the opening are shaped to receive the extensions on the holders. However, because the personalization characters are fitted into the rectangular holders and the tabs at the top and bottom of the holders are fully visible, it is clear that the personalization is not carved into a single block of material.

A need exists for an item that can be personalized simply and quickly so that it looks as if the personalization characters and symbols were carved into the item, when in fact, these characters and symbols were manufactured separately and added at a later time.

BRIEF DESCRIPTION OF THE INVENTION

In one aspect, an apparatus configured with characters for personalization is provided that comprises a frame member, character engagement areas, character blocks, and inserts. The frame member comprises a substantially rectangular recessed area formed therein. The character engagement areas each comprise a character placement template formed therein and are placed adjacent elongated sides of the rectangular recessed area opposite one another. Each character block comprises a first template engaging member, a second template engaging member, and a character rigidly retained therebetween. The first template engaging member is configured with a complimentary shape to a first character placement template to provide a mating engagement therebetween, and the second template engaging member is configured with a complimentary shape to a second character placement template to provide a mating engagement therebetween. The template engaging members are further configured to provide a spacing between adjacent characters. The plurality of inserts are configured for insertion into said frame member to substantially cover said character engagement areas and said template engaging members.

A method for fabricating a personalized item is also provided. The method comprises providing a frame member having a top surface, configuring the frame member with an area recessed from the top surface, providing a character placement template along at least one side of the recessed area, a top surface of the templates below the top surface of the frame member, and providing a plurality of character blocks having a character formed within, each character block including at least one template engaging member configured to provide spacing between characters of adjacent character blocks. The method further comprises engaging the template with the template engaging members of the character blocks and attaching at least one trim insert across the character placement template to cover the character placement template and the template engaging members, where the template and the trim insert are configured such that the trim insert is substantially flush with the top surface of the frame member when attached.

DETAILED DESCRIPTION OF THE INVENTION

Figure 1:
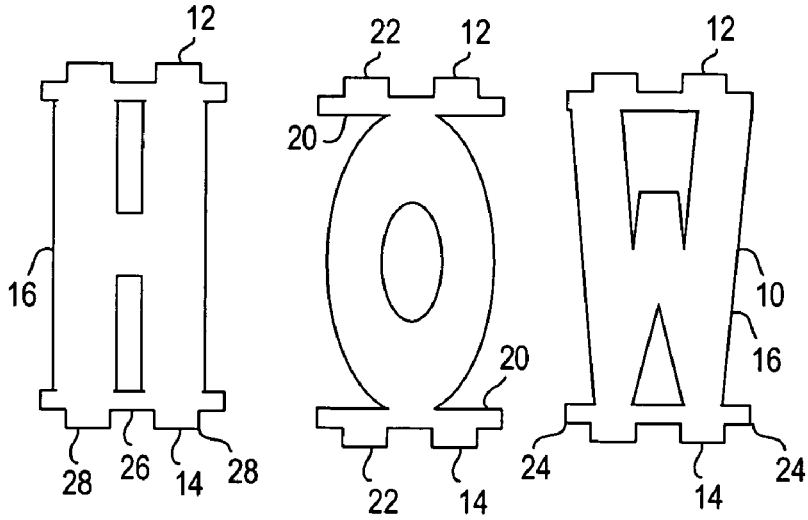
FIG. 1 is a front view illustration of a plurality of character blocks.

FIG. 1 is a front view of a plurality of character blocks 10. Each character block 10 includes a first template engaging member 12, a second template engaging member 14, and a character 16 retained therebetween. In an exemplary embodiment, character blocks 10 are fabricated from wood although character blocks 10 may be fabricated from any substance that can be molded or carved. In one embodiment, first template engaging member 12, second template engaging member 14, and character 16 are formed from a single piece of material. In another embodiment, first template engaging member 12 and second template engaging member 14 are separately fabricated and attached to character 16.

Figure 2:
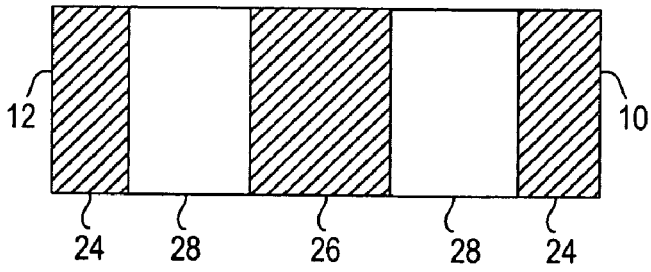
FIG. 2 is an end view of a character block.

Template engaging members 12 and 14 each include a character engaging side 20 and a template engaging side 22. Template engaging side 22 is formed having an alternating pattern which allows character blocks 10 to engage a template as further described below. As illustrated in FIGS. 1 and 2, and in an exemplary embodiment, each end portion 24 of template engaging side 22 is configured with an approximate one-half portion of the alternating pattern and each template engaging member 12 and 14 is of approximately equal width. The alternating pattern includes, for example, an indented portion 26 and a protruding portion 28. Stated differently, the amount of the alternating pattern for each template engaging member 12 and 14 is approximately equal which provides for, at least in part, an even distribution or equal spacing for a number of character blocks 10. In the illustrated embodiment, character blocks 10 are configured with an alternating pattern which is substantially rectangular, however, other alternating patterns, for example, a sinusoidal pattern, are considered to be within the scope of this disclosure. In the illustrated embodiment, end portions 24 are configured as an approximate one-half portion of the indented portion 26 of the alternating pattern.

FIG. 2 is an end view of one character block 10. FIG. 2 additionally illustrates indented portions 26 and protruding portions 28 for template engaging member 12 of character block 10 (template engaging member 14 is substantially the same as template engaging member 12 in this embodiment). As illustrated, end portions 24 are configured with a width that is approximately one-half the width of protruding portions 28 and the other indented portions 26 which, at least in part, provides for each character block 10 being of equal width and symmetry as the character blocks 10 engage a template as further described below. In one embodiment, all components of character blocks 10 have a substantially equal depth.

Figure 3:
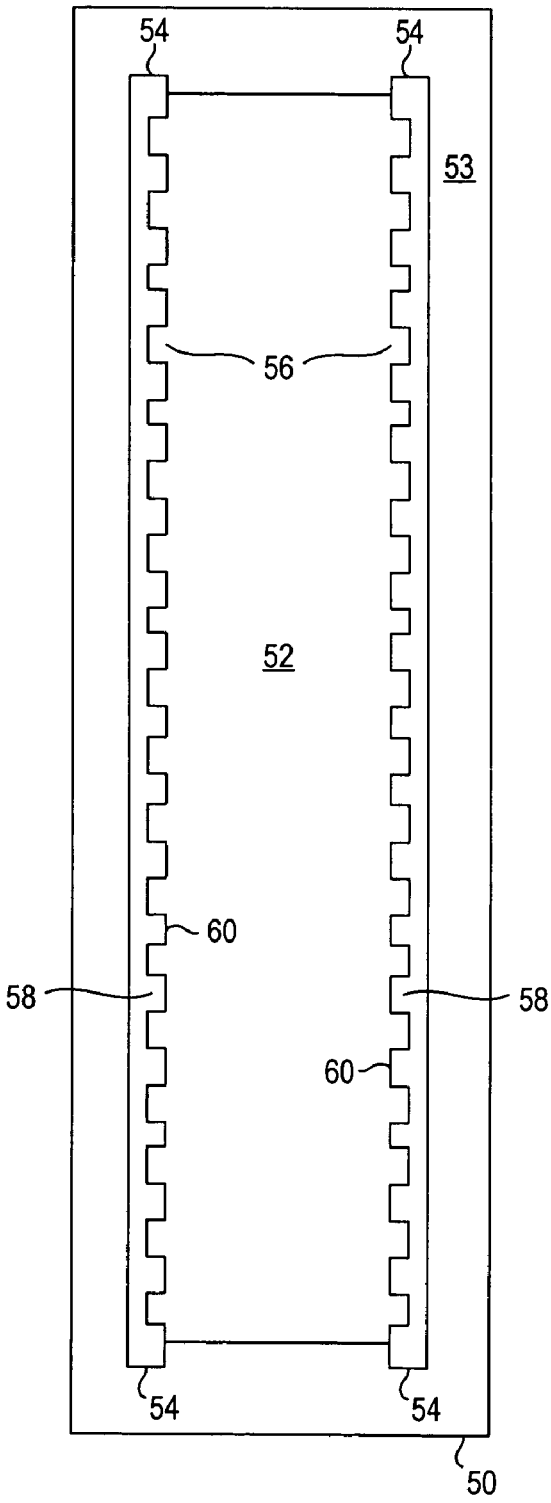
FIG. 3 is an illustration of a frame member including a recessed area and rectangular indentations having character placement templates formed therein.

FIG. 3 is a front view of a frame member 50. In one embodiment, frame member 50 is configured with a substantially rectangular recessed area 52 as compared to a frame member top surface 53. In an alternative embodiment, the recessed area is configured to extend all the way through the frame member, and will be described further with respect to FIG. 5 below. Opposite sides of recessed area 52 are further configured as character engagement areas 56. In the illustrated embodiment, a surface 58 of character engagement areas 56 is recessed with respect to top surface 53 of frame member 50 but not as deeply recessed as recessed area 52. Character engagement areas 56 further include character engaging templates 60 as further described below. In one embodiment, each character engagement area 56 extends beyond an end of recessed area 52. The portions of character engagement areas 56 that extend beyond the end of recessed area 52 are referred to herein as corner areas 54. Corner areas, which in alternative embodiments may be circular or elliptical in shape, are configured to engage one end portion of a trim piece as further described below. As illustrated, character engagement areas 56 including templates 60 provides surface 58 that engages the above described trim pieces. Surfaces 58 are a different depth than the remainder of recessed area 52 for retention of character blocks 10 with the trim pieces as further described below.

In various embodiments, frame member 50 is fabricated from wood, but plastics, composites, or any other material that can be milled or molded are contemplated as being within the scope of the invention. In various embodiments, frame member 50 is milled or machined so that recessed area 52 and character engagement areas 56 (including templates 60) can be fabricated as a part of frame member 50. Alternatively, frame member 50 may be fabricated with an enlarged recessed area 52 providing for separate fabrication of character engagement templates 60. After separate fabrication, templates 60 are placed into character engagement areas 56 and may be attached to the sides of the recessed area 52.

As described above, frame member 50 includes two character engagement areas 56 that are configured with character placement templates 60. As illustrated, templates 60 are configured with the same type of alternating pattern as character blocks 10 and may be formed within frame member 50 as a part of the fabrication of frame member 50. Alternatively, character engagement templates 60 are discretely fabricated and glued, stapled or otherwise attached within the character engagement areas 56 and to opposite sides of recessed area 52 within frame member 50. Though the alternating pattern formed in templates 60 and character blocks 10 is the same type of alternating pattern, the respective alternating patterns are complimentary to one another to allow for a mating engagement between templates 60 and character blocks 10, for example, with a fit between the two.

Figure 4:
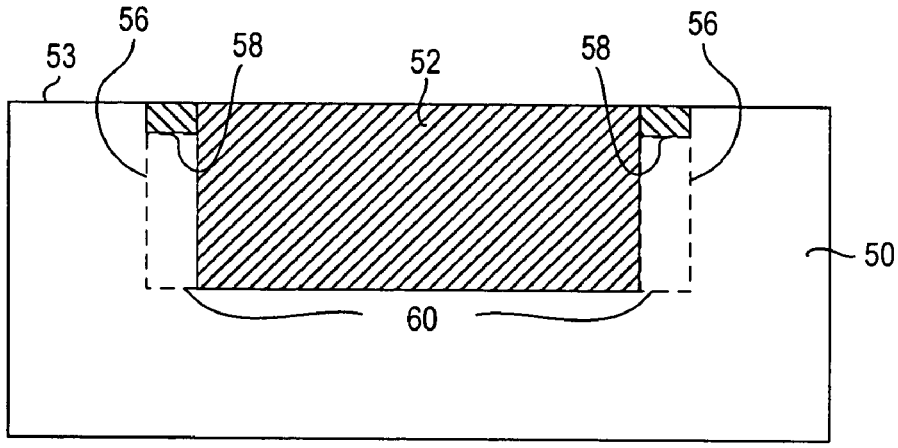
FIG. 4 is a cross-sectional view of a frame member illustrating a depth of one embodiment of a recessed area.
Figure 5:
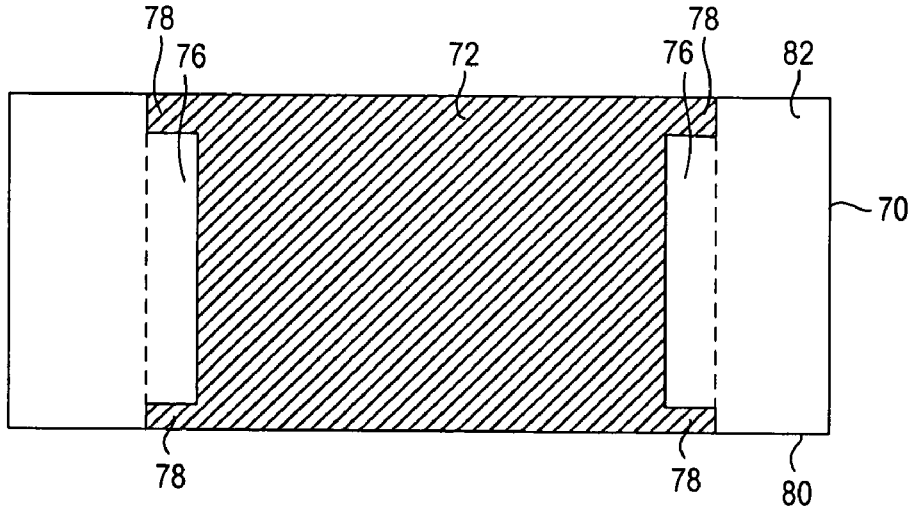
FIG. 5 is a cross-sectional view of a frame member that includes an opening extending therethrough.

FIG. 4 is a cross-sectional view of one embodiment of frame member 50 which illustrates that a majority of recessed area 52 is fabricated at a first depth and that character engagement areas 56 (including character engaging templates 60) are fabricated at a second depth that is less than the first depth. FIG. 5 is an illustration of a frame member 70 where recessed area 72 extends all the way through frame member 70. Though frame member 70 may also be configured with corner areas (not shown in FIG. 5) and rectangular character engagement templates 76, a set of rectangular indentations 78 are fabricated in both a bottom surface 80 and a top surface 82 of frame member 70 for insertion of trim pieces that may be substantially flush with surfaces 80 and 82 as further described below.

Figure 6:
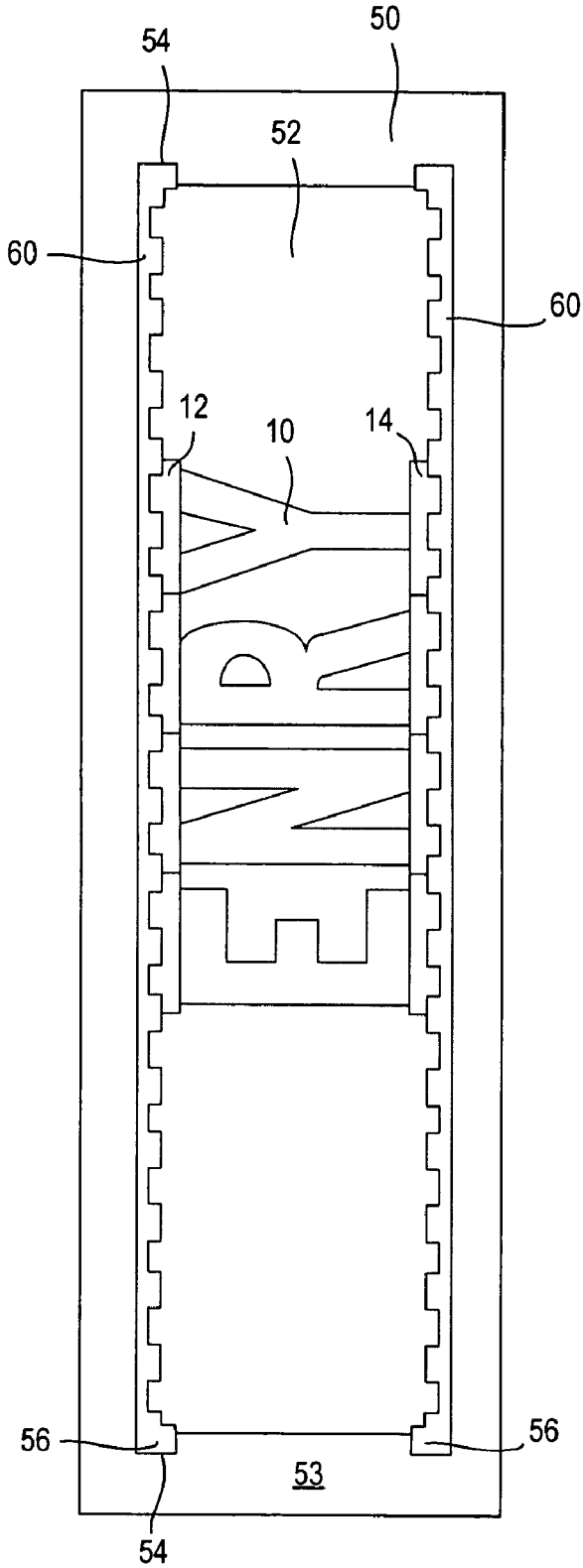
FIG. 6 is an illustration of a frame member having a plurality of character blocks inserted therein.

FIG. 6 is a front view of frame member 50 including character placement templates 60 therein and a plurality of character blocks 10 engaging templates 60. As illustrated, the alternating patterns of templates 60 and character blocks 10 allow for a rapid personalization of an item in which frame member 50 is incorporated. Character blocks 10 are simply inserted into the pattern of template 60, and in one embodiment may be substantially centered within recessed area 50. Further, template engaging members 12 and 14 are configured with a width such that spacing between characters 16 of adjacent character blocks 10 is achieved. As such no individual spacers between individual characters are needed as template engaging members 12 and 14 act as spacers. A shop or enterprise simply needs to stock an inventory of character blocks 10 and a plurality of widths of frame members 50, with corresponding templates 60, to provide for on the spot rapid personalization of items for customers.

Figure 7:
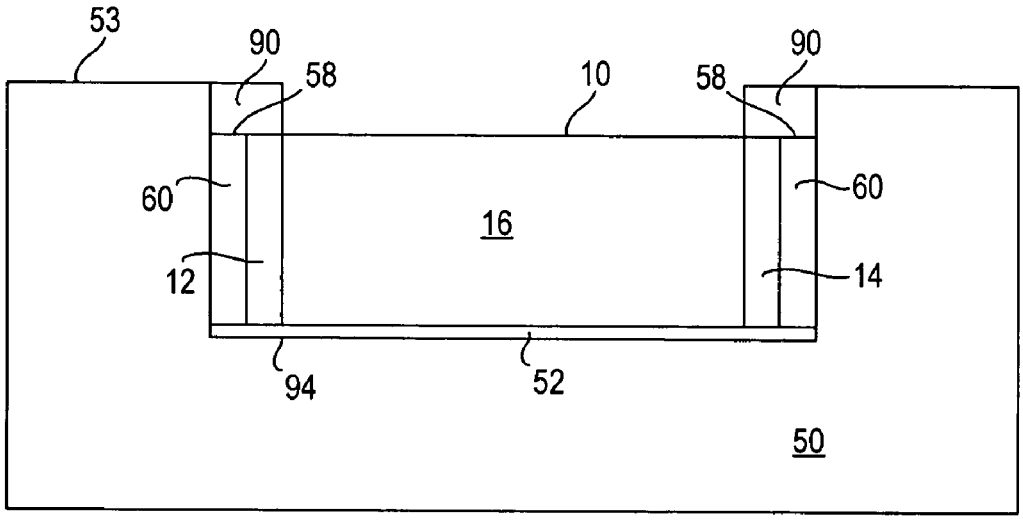
FIG. 7 is a cross-sectional view of a frame members having at least one character block inserted therein.

FIG. 7 is a side cross-sectional view of frame member 50 having at least one character block 10 inserted therein. In this illustrated embodiment, character blocks 10 have a depth that is approximately the same as character engagement area 56 which allows for the insertion of trim pieces 90 over character placement templates 60 and template engaging members 12 and 14 such that a top surface of trim pieces 90 are substantially flush with top surface 53 of frame member 50. Template engaging members 12 and 14 engage the respective template 60. Though in the illustrated embodiment the depth of character engaging template 60 is substantially equal to a depth of character 16, other embodiments exist where character engaging templates 60 are configured to not extend all the way through character engagement areas 56. In such embodiments, characters 16 configured with a depth such that they are suspended above a bottom surface 94 of recessed area 52.

In such an embodiment, the space between characters 16 and bottom surface 94 of recessed area 52 is thought to provide a finished appearance for the personalized item that is desirable.

Figure 8:
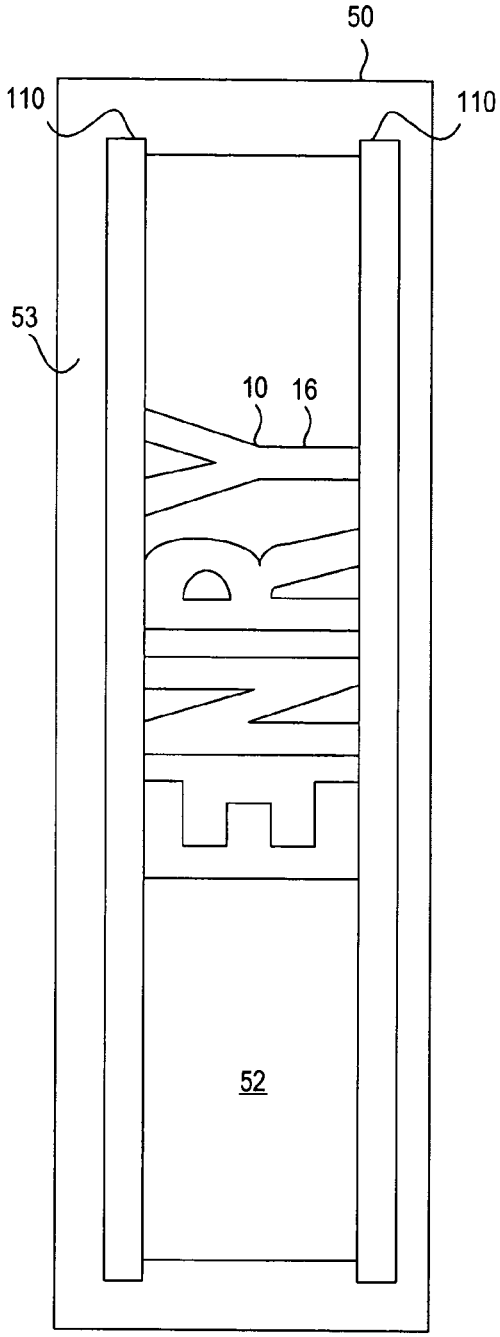
FIG. 8 is an illustration of a frame member and character block placed therein which also includes a plurality of inserts placed onto the frame member to cover the character placement templates.

FIG. 8 is an illustration of frame member 50 with character blocks 10 placed therein. Also included are a plurality of inserts 110 or trim pieces that are placed onto frame member 50 and across a top of the character engagement area 56. Placement of inserts 110 covers character placement templates 60 and template engaging members 12 and 14. In one embodiment, inserts 110, when placed in the proper position, are substantially flush with top surface 53 of frame member 50. The result is an appearance that leads a consumer to believe that characters 16 were carved into frame member 50. While trim pieces 110 are illustrated as being rectangular, other embodiments are also contemplated. For example, one embodiment of trim piece 110 is oblong in shape (the corresponding corner areas 54 are also shaped to mate with the oblong trim piece).

Figure 9:
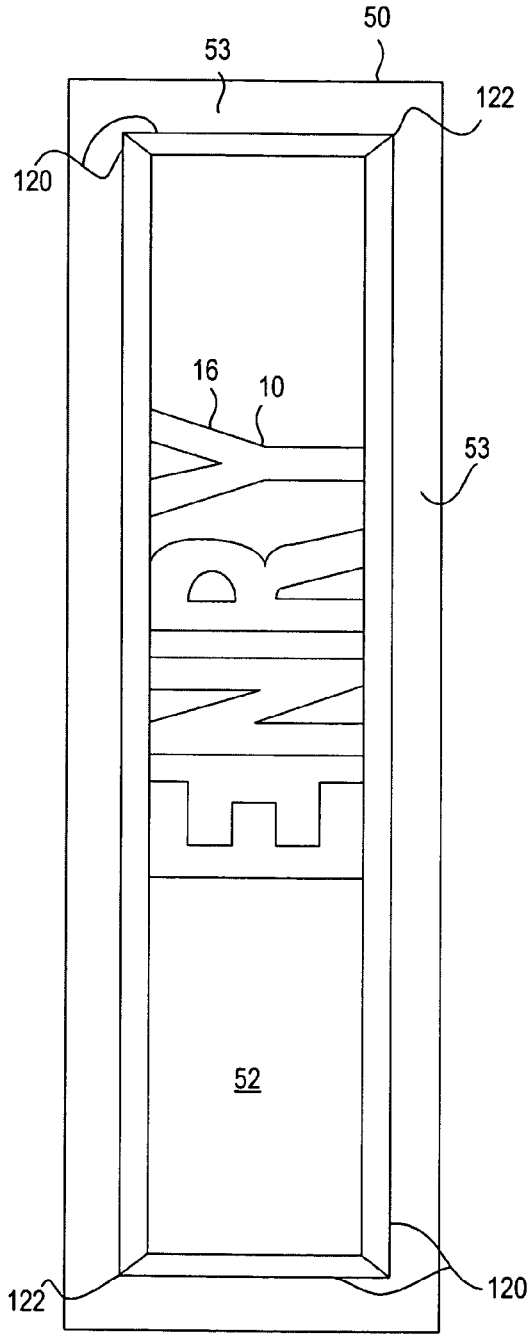
FIG. 9 is an illustration of a frame member and character block placed therein which also includes an alternative embodiment for inserts placed onto the frame member to cover the character placement templates.

FIG. 9 is an illustration of a frame member 50 and character blocks 10 placed therein which includes an alternative embodiment for inserts 120 placed onto the frame member 50. In the embodiment, rather than the surface 58 (not shown in FIG. 9) associated with a character engagement template 60 extending from corner area 54 to corner area 54 along an elongated side of recessed area 52 as described above with respect to FIG. 3, the indented surface substantially surrounds the rectangular recessed area 52. In such an embodiment, inserts 120 are therefore configured for insertion around a perimeter of recessed area 52. In specific embodiments, inserts 120 are also flush with top surface 53 of frame member 50. In the embodiment illustrated, ends 122 of inserts 120 are angled or mitered to provide a distinctive appearance for the finished assembly.

Referring to FIGS. 5 8, and 9, either configuration for trim pieces 110 and 120 can be utilized for a bottom of frame member 70 to a finished appearance on both sides of frame member 70 where the recessed area 72 extends all the way through frame member 70.

Figure 10:
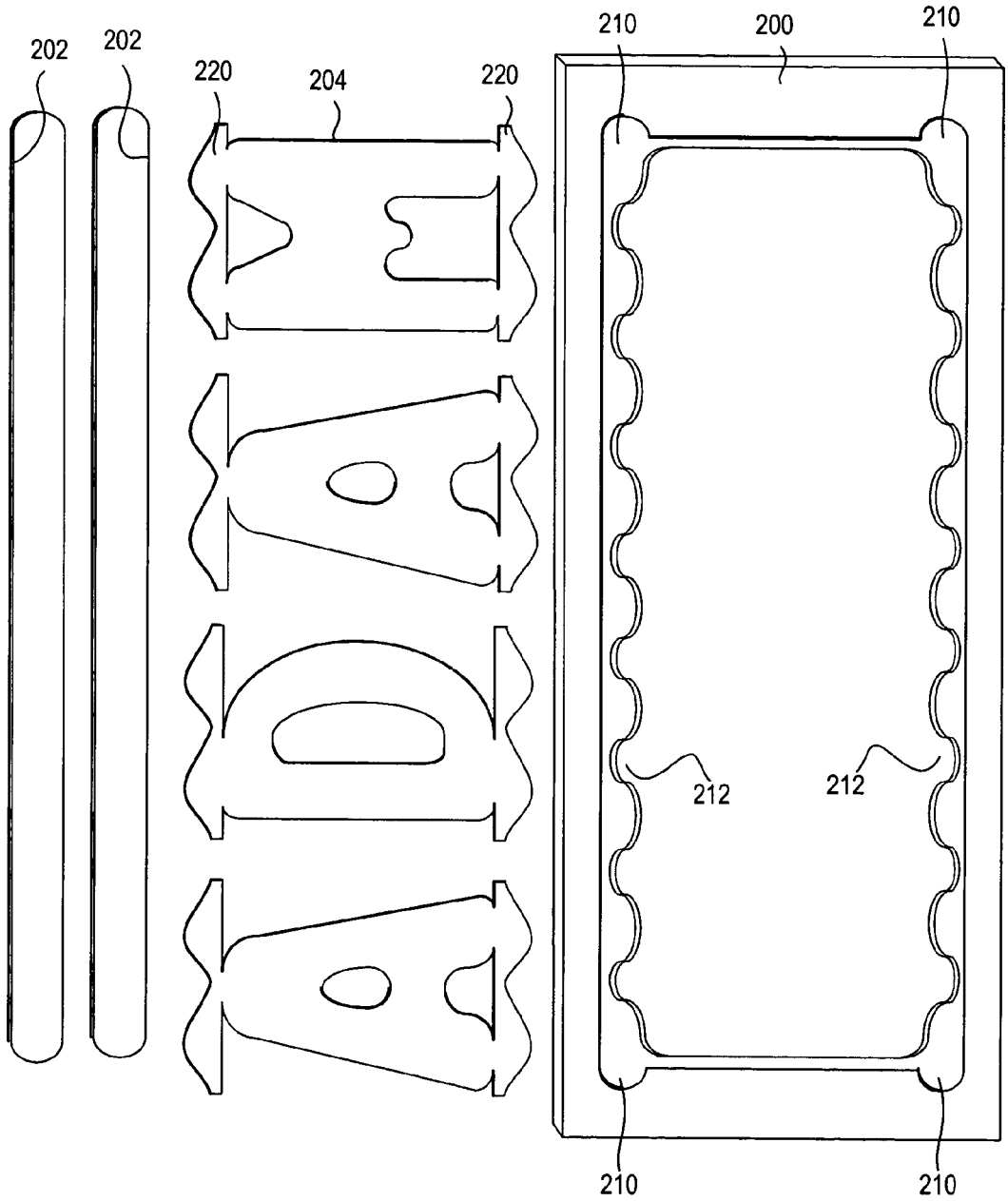
FIG. 10 is an illustration of alternative embodiments for a frame member, trim pieces, and character blocks.

FIG. 10 is an illustration of alternative embodiments for a frame member 200, oblong trim pieces 202, and character blocks 204. As illustrated corner areas 210 of frame member 200 are configured for insertion of oblong trim pieces 202, and frame member 200 is further configured with an alternative embodiment for character engagement areas 212. Template engaging members 220 of character blocks 204 are configured with a pattern that is complimentary to the pattern of character engagement areas 212.

The above described embodiments provide a system that is able to accept rigid characters for personalization of items while still providing a simple method for centering and spacing the characters while retaining the letters in place to provide an appearance that the item is of single piece construction. Therefore, while the invention has been described in terms of various specific embodiments, those skilled in the art will recognize that the invention can be practiced with modification within the spirit and scope of the claims.

What is claimed is:

1. An apparatus configured with characters for personalization, said apparatus comprising:

a frame member comprising a substantially rectangular recessed area formed therein;

a first character engagement area comprising a first character placement template formed therein, said first character engagement area adjacent a first elongated side of said rectangular recessed area;

a second character engagement area comprising a character placement template formed therein, said second character engagement area adjacent a second elongated side of said rectangular recessed area and opposite said first character engagement area;

a plurality of character blocks, each said character block comprising a first template engaging member, a second template engaging member, and a character rigidly retained therebetween, said first template engaging member configured with a complimentary shape to said first character placement template to provide a mating engagement therebetween, said second template engaging member configured with a complimentary shape to said second character placement template to provide a mating engagement therebetween, said template engaging members configured to provide a spacing between adjacent said characters; and a plurality of inserts configured for insertion into said frame member to substantially cover said character engagement areas and said template engaging members, wherein said inserts, when inserted, are configured to be substantially flush with a top surface of said frame member.

2. A personalized item according to claim 1 wherein said template engaging members are substantially the same width for all said character blocks.

3. A personalized item according to claim 1 wherein the complimentary shapes within said character placement templates and said template engaging members are configured as an alternating pattern, the alternating pattern providing for the engagement between said character placement templates and said template engaging members.

4. A personalized item according to claim 1 wherein said frame member and said character engagement areas are formed as a single piece fabrication.

5. A personalized item according to claim 1 wherein said character engagement areas are formed separately and attached to sides of said recessed area.

6. A personalized item according to claim 1 wherein said character engagement areas are configured to be recessed from a top surface of said frame member.

7. A personalized item according to claim 1 wherein said personalized item is fabricated from at least one of wood, plastic, and a composite material.

8. A personalized item according to claim 1 wherein said character engagement areas and said inserts are substantially rectangular.

9. A personalized item according to claim 1 wherein a portion of said frame member comprises an indentation adjacent said recessed area and at substantially the same depth as a top surface of said character engagement areas, said character engagement areas and said indentation configured to form a perimeter around said recessed area, said inserts configured for insertion within the formed perimeter.

10. A personalized item according to claim 1 wherein said frame member comprises a bottom surface and a top surface, said recessed area extends through said frame member said top surface and said bottom surface, said bottom surface comprising at least one rectangular indentation adjacent said recessed area, said at least one rectangular indentation configured to accommodate a portion of said inserts.

11. A method for fabricating a personalized item, said method comprising:

providing a frame member having a top surface;

configuring the frame member with an area recessed from the top surface;

providing a character placement template along at least one side of the recessed area, a top surface of the templates below the top surface of the frame member;

providing a plurality of character blocks each including a character formed within, and at least one template engaging member configured to provide spacing between characters of adjacent character blocks;

engaging the template with the template engaging members of the character blocks; and attaching at least one trim insert across the character placement template to cover the character placement template and the template engaging members, the template and the trim insert configured such that the trim insert is substantially flush with the top surface of the frame member when attached.

12. A method according to claim 11 further comprising configuring the template engaging members and the character placement templates with an alternating pattern.

13. A method according to claim 11 wherein configuring the frame member comprising forming a recessed area that extends completely through the frame member, said method further comprising:

configuring the bottom surface of the frame member with an indentation adjacent at least one side of the recessed area; and attaching at least one trim insert to be flush with the bottom surface of the frame member and cover the character placement template and the template engaging members.

14. A method according to claim 11 further comprising:

forming an indentation adjacent each side of the recessed area not configured for a character placement template, the indentations substantially flush with a top surface of the character placement templates; and attaching trim inserts to be flush with the top surface of the frame member to cover the character placement template, the template engaging members, and the indentations.

15. A method according to claim 11 wherein providing a character placement template along at least one side of the recessed area comprises:

forming at least one character placement template; and attaching the character placement templates to opposing sides of the recessed area.

16. A method according to claim 11 further comprising forming the template engaging members with substantially equal widths.

* * * * *